US006046142A

United States Patent [19]

Zilonis et al.

[11] Patent Number: 6,046,142

[45] Date of Patent: Apr. 4, 2000

[54] COMPOSITION TO SUBSTANTIALLY REDUCE HOOKS OR SLICES IN GOLF SHOTS

[76] Inventors: Stephen A. Zilonis, 51 Edgar Rd., Scituate, Mass. 02006; Michael McLellan, 365 Webster St., Marshfield, Mass. 02050

[21] Appl. No.: 09/027,004

[22] Filed: Feb. 20, 1998

[51] Int. Cl.[7] ..... C10M 125/00; C10M 101/02; C10M 145/40; A63B 37/00

[52] U.S. Cl. ..... 508/154; 508/307; 508/591; 473/324

[58] Field of Search ..... 508/154, 304, 508/591, 307; 473/324

[56] References Cited

U.S. PATENT DOCUMENTS

| | | | |
|---|---|---|---|
| 3,896,038 | 7/1975 | Hartle . | |
| 3,966,210 | 6/1976 | Rozmus | 273/169 |
| 4,502,687 | 3/1985 | Kochevar | 273/171 |
| 4,518,489 | 3/1985 | Hitzman | 208/223 |
| 5,120,358 | 6/1992 | Pippett | 106/19 |
| 5,150,906 | 9/1992 | Molitor et al. | 273/220 |
| 5,597,364 | 1/1997 | Thompson | 473/314 |
| 5,643,110 | 7/1997 | Igarashi | 473/330 |
| 5,743,812 | 4/1998 | Card | 473/327 |
| 5,827,133 | 10/1998 | Chang | 473/354 |
| 5,885,171 | 3/1999 | Sharpe | 473/330 |

*Primary Examiner*—Margaret Medley
*Attorney, Agent, or Firm*—Wolf, Greenfield & Sacks, P.C.

[57] ABSTRACT

The present invention relates to a method for hitting an object in a substantially straight-line pathway. The method comprises the steps of applying a composition to a hitting surface and impacting the object. In particular, the composition can be applied to a golf club face to reduce hooks or slices. The composition is a product of a mixture comprising a saturated oil, a water soluble lubricant and an aqueous carbon dioxide solution.

12 Claims, No Drawings

COMPOSITION TO SUBSTANTIALLY REDUCE HOOKS OR SLICES IN GOLF SHOTS

BACKGROUND

1. Field of the Invention

The present invention relates to a composition that helps reduce hooks or slices in golf shots, and more particularly a composition that is applied to the hitting face of a golf club.

2. Background of the Invention

One of the most frustrating aspects of golf is a tee shot that goes awry. Putting and short range chipping can also be problems for golfers, but if the first shot is not reasonable, the next several strokes may be recovery shots or shots from bad angles or lies, that is, if the golfer can even find the ball.

Typically, the hook or slice is caused by a poor grip. Sometimes, the swing is at fault. Regardless, unless the golfer has practiced and practiced, it is likely that many of the tee shots will either hook or slice. For the casual player or "hacker," driving the first shot into the woods or out of bounds limits the enjoyment of the game. Many people simply do not have the time or patience to practice grips or swings, and when given the opportunity to play, the occasional golfer may choose not to play to avoid either embarrassment or spending several hours "in the woods."

Even more seasoned players who only occasionally hook or slice sometimes need to consistently hit straight balls for practice. For example, when trying to judge distances that the golfer hits the ball with a particular club, slices and hooks only waste time or causes inaccurate measurements.

DETAILED DESCRIPTION

The present invention provides a composition for application to devices typically used to strike a moving or stationary object and project it at a distance. Most typically, the composition is applied to a golf club head/face, although other applications are within the scope of the invention. The composition substantially reduces spin on an impacted golf ball, resulting in a substantially straight-line pathway of the ball. The substantially straight-line pathway results regardless of the style or form of a golf swing. The composition is applied to, and adheres to the golf club face for the duration of the golf swing. After impact, the golf club face and the golf ball are substantially free of the composition.

Typically, sufficient impact between a golf club face and a golf ball will project the golf ball through the air in a forward direction. Due to friction between a golf club face and the golf ball during impact, a spin component may be imparted to the golf ball. Therefore, the golf ball may significantly diverge from a substantially straight-line pathway depending on the direction of the spin component. Removing the spin component from the golf ball would allow the impacted golf ball to follow a more substantially straight-line pathway.

In one aspect of the present invention, a composition includes a saturated oil, a water-soluble lubricant and an aqueous carbon dioxide solution. The present composition including the unsaturated oil reduces the friction between the golf club face and the golf ball, and substantially reduces the spin component on the golf ball after impact. "Saturated oil" as used herein refers to an oil in which a primary component molecule is free of double bonds. In one embodiment of this aspect of the invention, the saturated oil is a hydrocarbon having a formula $C_nH_{2n+2}$. In another embodiment of the composition, the saturated oil is a "petrolatum,"

which as used herein, is defined as a purified colloidal mixture of non-straight-chain solid hydrocarbons and high-boiling liquid hydrocarbons. The petrolatum can be selected from the group consisting of petroleum jelly, paraffin jelly, vasoliment, and mixtures thereof. A commercially available petrolatum is White Protopet 1S®, available from Witco Corp., Greenwich, Conn. In another embodiment, the saturated oil is a silicone having a repeat unit of —$[R_2Si—O]_n$— wherein the value "n" is an integer.

The composition has a viscosity sufficient to adhere to the golf club face for the duration of a golf swing. The adherence of the composition and the sufficiency of the viscosity of the composition, can be measured by a viscosity screening test. The test includes measuring and applying an amount of the composition to a golf club face, swinging the golf club with a standard golf swing, and measuring the amount of the composition remaining on the golf club face. The step of swinging the golf club does not involve actually impacting a golf ball, but does include the substeps of a standard golf swing having a rotation of at least 180°, with a back swing and a forward swing having sufficient force to project a golf ball. If the viscosity of the composition is too low, it will run down the golf club face immediately after application. A highly viscous composition will adhere to the golf ball after impact. Accordingly, another viscosity screening test involves applying the composition to the golf club face, impacting a golf ball to project the ball, allowing the ball to come to rest, and assessing whether the golf ball is substantially free of the composition.

The composition also has a volumetric shape upon applying the composition to the golf club face. The volumetric shape is typically spherical with a diameter of at least about 5 mm and is an important parameter in determining whether a sufficient amount of the composition is applied to the golf club face to contact the ball. The volumetric shape allows the composition to be used economically in that a large percentage is not wasted by spreading it over the entire golf club face, as would be necessary with a low viscosity compound that does not have a volumetric shape. The present composition has sufficient viscosity to maintain the volumetric shape for the duration of the golf club swing. The composition's volumetric shape can be evaluated by applying the composition of a particular volumetric shape to the golf club face, swinging the golf club with a standard golf swing, and assessing whether the volumetric shape after swinging resembles the volumetric shape before swinging. As with the viscosity screening test, the step of swinging the golf club does not involve actually impacting a golf ball.

To achieve the desired viscosity levels for the composition, the saturated oil has a desired viscosity range. The National Lubricating Grease Institute (NLGI) provides a standard to assess viscosity levels. For example, a lubricant having an NLGI grade of 1 has the viscosity of a semisolid liquid, whereas a lubricant having an NLGI grade of 3 has the viscosity of a thick paste. Preferably, the saturated oil has an NLGI grade of between about 1 and about 3; more preferably, the saturated oil has an NLGI grade of between about 1.5 and about 2.5, and more preferably still, the saturated oil has an NLGI grade of between about 1.75 and about 2.25.

In another embodiment, the saturated oil is a "liquid petrolatum," which as defined herein, is a mixture of liquid hydrocarbons derived from petroleum. Petroleum comprises a mixture of hydrocarbons obtained from crude oil, mineral oil, rock oil, coal oil or seneca oil. Petroleum may also contain small amounts of benzene hydrocarbons, sulfur and oxygenated compounds. The liquid petrolatum can be selected from the group consisting of liquid paraffin, mineral oil, white mineral oil, paraffin oil and mixtures thereof. In another embodiment, the saturated oil is a mixture of petrolatum and liquid petrolatum in a ratio of between about 1:1 to about 10:1. A preferred ratio of petrolatum and liquid petrolatum is 8:1. In a preferred embodiment, the saturated oil is a mixture of petroleum jelly and mineral oil. In this embodiment, the liquid petrolatum functions to improve the miscibility of the composition and fine tune the viscosity of the composition to a desired level.

The composition has a compressibility sufficient to allow a substantial amount of the composition to remain between the golf club face and the golf ball during impact. Unlike gases, liquids are generally noncompressible. Thus, applying a liquid to a golf club face and impacting a golf ball forces the liquid out from under the ball. The present composition includes a substance that allows the composition to become compressible. Moreover, the golf ball and golf club face is preferably substantially free of the substance after impact. In a preferred embodiment, the substance is an aqueous carbon dioxide solution. Because of carbon dioxide gas bubbles in the aqueous solution, the resulting composition is physically compressed during impact between the golf club face and the golf ball. The aqueous carbon dioxide solution can be prepared by methods known to those of ordinary skill in the art. For example, subjecting water to carbon dioxide under a pressure of 70 psi or even lower, will readily produce a saturated aqueous carbon dioxide solution.

Aqueous solutions, including aqueous carbon dioxide solutions, are immiscible with the saturated oil in the present composition. Thus, the present composition also includes a water-soluble lubricant. Preferably, the water-soluble lubricant is a cellulose gel, which is typically provided as a powder and commonly sold as a food additive and fluid thickener. In the present composition, the aqueous carbon dioxide solution is initially mixed with the water-soluble lubricant prior to the addition to the saturated oil. To keep the solution saturated with carbon dioxide, the initial mixing is performed in a carbon dioxide-rich environment. The mixing step is typically performed at room temperature and atmospheric pressure and is complete when the composition has a homogeneous texture and color.

Other desirable attributes of the present composition relate to product safety and stability issues. Each substance in the composition has low toxicity levels and is used in a number of cosmetic and health care products. Consequently, contacting the composition with the skin provides relatively low health risks. The composition does not degrade under ordinary conditions of use, and moreover, the composition does not degrade other substances. Golf clubs, notably the woods, are typically covered with a finish coating that will not be compromised by use of the present composition.

Having thus described various embodiments of the invention, numerous modifications within the scope of the invention will occur to those skilled in the art. Thus, this description is provided by way of example only and is not intended to be limiting. The function and advantage of these and other embodiments of the present invention will be more fully understood from the example below. The following example is intended to illustrate the benefits of the present invention, but does not exemplify the full scope of the invention.

EXAMPLE 1 PREPARATION OF THE COMPOSITION

The example provides one quart of the composition. Four units of a water soluble lubricant such as KY Jelly® lubricant, available from Johnson & Johnson, New Brunswick, N.J., were combined with 1 unit of cold soda water. One drop of vegetable dye was added. The mixture was whipped to an even consistency with a mixer under a carbon dioxide-rich environment until the mixture had a homogeneous consistency and color. Eight units of the protopet 1S®, available from, Witco Corp., Greenwich, Conn., and one unit of mineral oil were combined and mixed to an even consistency. The water soluble lubricant mixture and Proto pet mixture were then combined in a mixer supplied with a gas inlet. The atmosphere in the blender was replaced with carbon dioxide and the mixture was whipped for approximately five minutes or until the mixture achieved a homogeneous consistency and color.

Those skilled in the art would readily appreciate that all parameters listed herein are meant to be exemplary and that actual parameters will depend upon the specific application for which the methods and apparatus of the present invention are used. It is, therefore, to be understood that the foregoing embodiments are presented by way of example only and that, within the scope of the appended claims and equivalents thereto, the invention may be practiced otherwise than as specifically described.

What is claimed is:

1. A product of a mixture for applying on a face of a golf club, comprising:

a saturated oil in an amount between about 60% and 90%;

a water-soluble lubricant in an amount between about 20% and 50%; and an aqueous carbon dioxide solution in an amount between about 5% and 20%.

2. The product of claim 1, wherein the saturated oil has an NLGI grade of between about 1 and about 3.

3. The product of claim 2, wherein the saturated oil has an NLGI grade of between about 1.5 and about 2.5.

4. The product of claim 3, wherein the saturated oil has an NLGI grade of between about 1.75 and about 2.25.

5. The product of claim 1, wherein the saturated oil is a mixture of hydrocarbon compounds.

6. The product of claim 5, wherein the saturated oil is a petrolatum.

7. The product of claim 5, wherein the saturated oil includes petrolatum and liquid petrolatum.

8. The product of claim 7, wherein the saturated oil includes petrolatum and liquid petrolatum in a ratio of between about 1:1 to about 10:1.

9. The product of claim 6, wherein the petrolatum is petroleum jelly.

10. The product of claim 7, wherein the liquid petrolatum is mineral oil.

11. The product of claim 1, wherein the water soluble lubricant is a cellulose gel.

12. A method for projecting a golf ball along a substantially straight-line pathway, comprising:

applying a composition to a golf club face, wherein the composition comprises saturated oil in an amount between about 60% and 90%, a water-soluble lubricant in an amount between about 20% and 50% and an aqueous carbon dioxide solution in an amount between about 5% and 20%;

impacting the golf ball with the golf club face.

* * * * *